United States Patent [19]

von Philipp et al.

[11] Patent Number: 4,707,866

[45] Date of Patent: Nov. 24, 1987

[54] DEVICE FOR ADDING DISINFECTANTS OR THE LIKE TO THE FLUSHING WATER OF A WC

[75] Inventors: Fritz von Philipp; Horst Hautmann, both of Neuburg, Fed. Rep. of Germany

[73] Assignee: Globol Werk GmbH, Neuburg, Fed. Rep. of Germany

[21] Appl. No.: 937,256

[22] Filed: Dec. 3, 1986

[30] Foreign Application Priority Data

Dec. 4, 1985 [DE] Fed. Rep. of Germany ..... 3542944

[51] Int. Cl.[4] ..... E03D 9/02

[52] U.S. Cl. ..... 4/228; 4/227; 4/222

[58] Field of Search ..... 4/228, 227, 222, 231

[56] References Cited

U.S. PATENT DOCUMENTS

| | | | |
|---|---|---|---|
| 3,914,805 | 10/1975 | Dolan | 4/227 |
| 3,953,902 | 5/1976 | Taylor | 4/227 |
| 4,209,863 | 7/1980 | Lindauer | 4/227 |
| 4,436,269 | 3/1984 | Dirksing et al. | 4/227 X |
| 4,453,278 | 6/1984 | Doggett et al. | 4/227 X |
| 4,455,692 | 6/1984 | Hegge et al. | 4/228 |
| 4,462,121 | 7/1984 | Dirksing et al. | 4/228 |
| 4,581,777 | 4/1986 | Newgard et al. | 4/227 X |

FOREIGN PATENT DOCUMENTS

| | | | |
|---|---|---|---|
| 3517653 | 11/1985 | Fed. Rep. of Germany | 4/227 |
| 2532347 | 3/1985 | France | 4/227 |

*Primary Examiner*—Henry K. Artis

*Attorney, Agent, or Firm*—Townsend & Townsend

[57] ABSTRACT

Means for adding disinfectant or the like to the flushing water of a WC comprise two layers, one of which is deep drawn to form a chamber. The other layer seals the chamber. The layer sealing off the chamber comprises a water-resistant material and is provided on at least one of its two surfaces with print or the like. A lower base portion of the chamber serves to enable the storage of the means in an upright position on a shelf or the like.

6 Claims, 3 Drawing Figures

DEVICE FOR ADDING DISINFECTANTS OR THE LIKE TO THE FLUSHING WATER OF A WC

This invention concerns a device for adding disinfectants or the like to the flushing water of a WC.

A device for adding disinfectants or the like to the flushing water of a WC comprises a first layer which assumes the shape of a chamber by means of deep drawing. This first layer is applied to a second layer having a larger surface area, this second layer comprising cardboard or paper material. The purpose of the second layer is to serve as an advertising medium. Apart from that it may also include operating instructions.

A particular drawback is that the complete device cannot be inserted in a flushing box; only the tablet contained in the device can be inserted. For this purpose the tablet is held in the chambers formed between the two layers solely for selling it. When using the tablet the second layer is opened by pressing it in at the perforations in the region of the chamber, whereby the tablet becomes accessible and can be inserted in the flushing box of a WC. This known device has the inherent disadvantage that it serves as a package only, that the package is discarded after removing the tablet and that the user of the tablet-like disinfectant has to take hold of the tablet to insert it in the flushing box of a WC. The tablet may also comprise a deodoriser with the result that after removing the tablet the user's fingers will always smell of the deodorant.

German utility model No. 79 19 664 describes means of the type described above, comprising a chamber-like container, a lid and a laterally insertable siphon. In the case of this means a mounting hook is formed on the container. Although this means is suitable for insertion in a flushing box it is conventionally provided with a package and offered for sale with this package. Therefore this device also has the disadvantage of having an additional package so that the package has to be torn open before it can be inserted. The package is discarded and the device itself is inserted in the flushing box.

It is therefore an object of the present invention to provide device of the type described above which can be used directly in a flushing box in the simplest manner.

The invention provides a device for adding disinfectant or the like to the flushing water of a WC comprising a first layer, which has substantially assumed the shape of a chamber, by deep drawing or the like, and a second layer covering the chamber, and at least on the base section embodied in the lower portion of the chamber, the second layer comprises a water-resistant material which is connected closely at regions to the first layer defining the chamber, the second layer being provided with print on at least one of its two surfaces.

The inventive device has the advantage that the block or tablet-shaped active ingredient can be inserted in the flushing box of a WC without having to be touched and that, in particular, there is no longer any need for a package that would have to be removed when the device is used.

The fact that a package is no longer required in accordance with the invention means that the corresponding manufacturing costs no longer arise, thereby substantially reducing the manufacturing costs of the device.

It is particularly advantageous that the inventive device can be placed upright on a shelf and can be thus inserted directly in the flushing box of a WC. According to a preferred embodiment the mounting hook is attached to the device and is vertically adjustable.

The device is provided with inlet and outlet openings so that during flushing the water in the chamber containing dissolved active agent can emerge by means of a siphon pipe, preferably in a dosed amount. After flushing, fresh water flows into the chamber through the inlet opening as the level of the water in the flushing box increases and again dissolves active agent.

Particularly advantageous is the use of a material for the second layer which, apart from being water-resistant, allows imprinting on both sides thereof. In this way the necessary advertising slogans or the like can be printed on the front or rear of the second layer. No further material layers or packages are required as advertising medium or the like. The first layer of material preferably comprises a transparent or opaque material, on the one hand for determining whether the tablet of active agent is fully used up or not and at the same time for transmitting the advertising print on the second layer.

Preferred embodiments of the invention will now be described in detail with reference to the drawing, in which.

Figure 1:
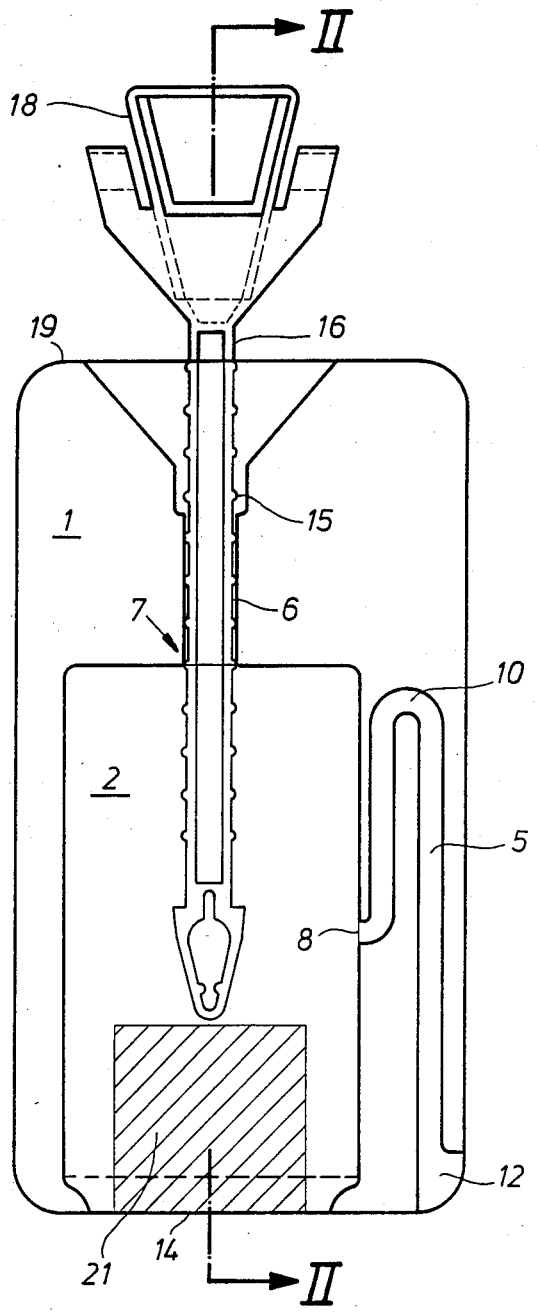
FIG. 1 is a top view of the device.
Figure 2:
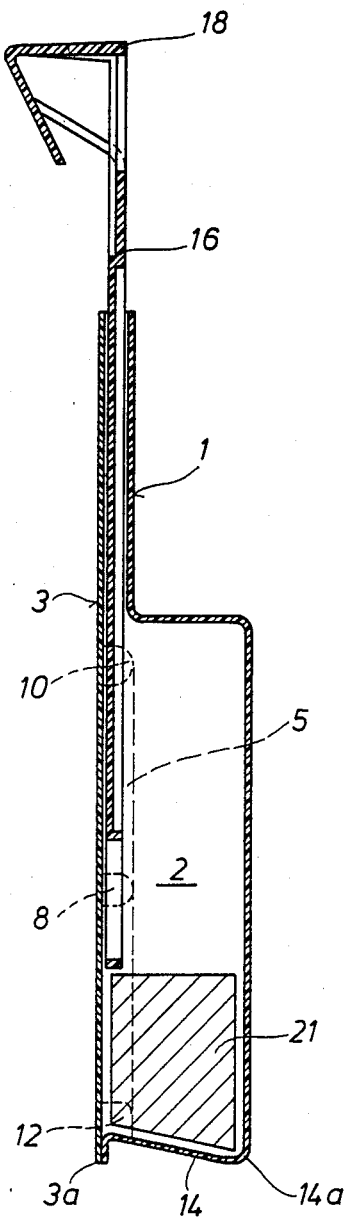
FIG. 2 is a sectional view along the line II—II in FIG. 1.

FIG. 1 shows a preferred embodiment of the invention. This device, which is also referred to as a dispenser, comprises two layers as shown in FIG. 2, a first layer 1, which is deep drawn to form a chamber 2 for holding active agent in the shape of a tablet or the like, and a second layer 3 which closes the rear of the chamber 2 and is partly connected to layer 1. Parts of layers 1 and 3 are parallel except for regions formed by the chamber 2 and passages or pipes to be described in the following.

The preferred embodiment of the device shown in FIG. 1 is a top view showing layers 1 and 2 of equal surface area. In this embodiment the layer 1 defines, apart from the chamber 2, a laterally attached siphon pipe 5 and an upper inlet passage 6 which is vertical when the device is in use. An opening indicated by numeral 7 is generally provided on the upper side of the chamber 2. In the embodiment shown in FIG. 1 this opening opens into the passage 6. A further opening 8 is provided to the side of the chamber 2, thereby making it possible to establish a communication with the siphon pipe 5. In the embodiment example shown, the siphon pipe 5 extends vertically upwards from about the middle of the chamber 2 and has a siphon section 10 at about the level of the opening 7 or therebelow. This is followed by a pipe section extending substantially vertically downwards and defining an opening 12 facing outwardly.

The layer 1 comprises a preferably transparent or translucent plastic material which can be shaped by means of a deep drawing process so as to form the finished layer 1 which is provided with chambers, siphon pipe and the like. After the deep drawing process the layer 1 is firmly connected at coinciding or parallel portions to the material layer 3. The material layer 3 comprises a water-resistant material, by way of examply water-resistant paper, plastic foil, PVC, polyethylene, plastic-metal laminates or paper laminates. It is important that the layer 3 cannot be dissolved by the water when it is inserted in the flushing box of a WC. It should also be substantially resistant to chemicals. Also, the layer 3 should have surface properties which allow an impression to be made on the surface facing layer 1, or preferably on both surfaces so that both sides can be printed with advertising slogans, texts and the like.

In order to be able to set the means upright on a shelf or the like the lower surface or base 14 of the chamber 2 is embodied so as to protrude from the lower edge 3*a* of the layer 3 at an angle of less than 90° and extend at a downward slope from the layer 3, as is shown in FIG. 2. In the latter case, the base 14*a* is a stand which is preferably on the same level as the edge 3*a* of the material layer 3, so that the whole device can stand preferably fully upright on a shelf.

In the embodiment according to FIGS. 1 and 2 the upper opening 7 of the chamber 2 opens into a vertical passage 6 which is provided for holding the base portion 16 of a mounting hook 18 and which serves to permit the entry of water through the passage 6 and the opening 7 into the chamber 2 while the water level rises when inserted in a flushing box, i.e. the water enters as soon as the water level in the flushing box rises above the upper edge indicated by reference numeral 19. In this way water is allowed to enter into the chamber 2 and to act on the active agent tablet indicated by numeral 21. When the flushing box is emptied the water with the agent dissolved therein passes through the siphon pipe 5 and the opening 12 into the flushing box and is flushed into the WC. In so doing, the siphon pipe 5 serves, as is known per se, to ensure that a dosed amount of the solution is allowed into the flushing box.

In order to be able to use the inventive device in a flushing box without further requirements the base portion 16 of the mounting hook is already inserted in the device when it is stored upright on a shelf.

In accordance with a preferred embodiment the height of the base portion 16 of the mounting hook 18 can be adjusted on the device to thereby make it possible to set the upper edge 19 at the maximum water level in the flushing box. In accordance with one embodiment example the base portion 16 is provided with lateral shoulders 15, whose diameter inside is selected to be slightly larger than the internal diameter of the passage 6; for adjusting and setting the height of the base portion 16 of the mounting hook 18. In this way the base portion 16 maintains its position within the passage 6 after the hook 18 has been appropriately set with respect to the device. As shown in FIG. 1 the chamber 2 is larger or higher than the tablet 21. This ensures that an adequate amount of water is taken into the chamber 2 for dissolving the tablet.

Figure 3:
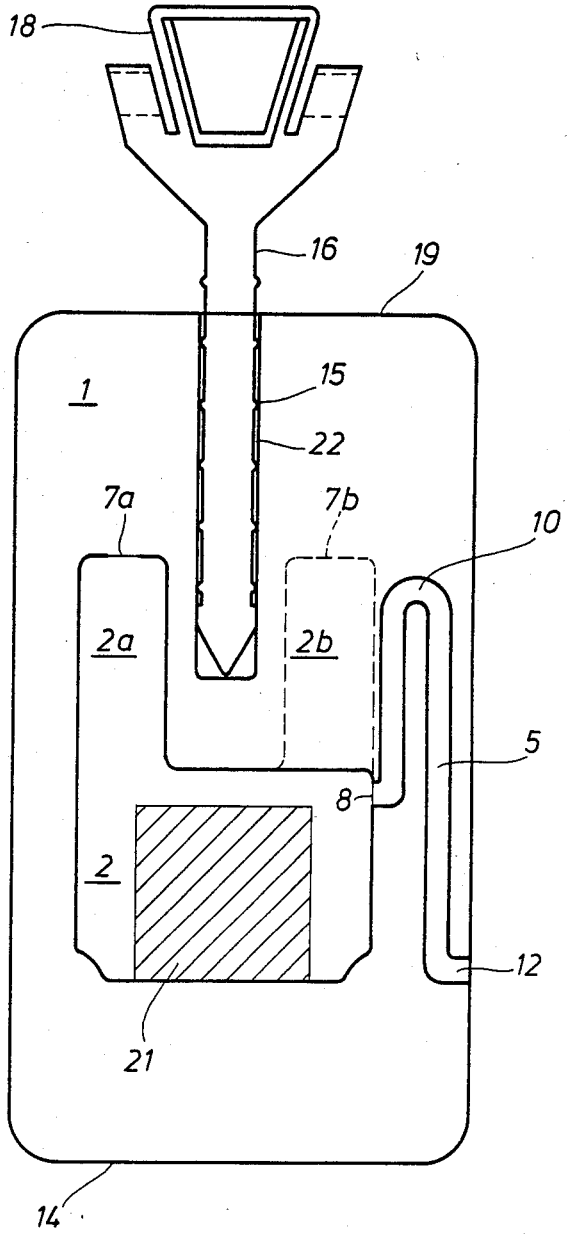
FIG. 3 is an embodiment of the device which is varied in comparison to the one shown in FIG. 1.

In the varied embodiment shown in FIG. 3 the base 16 of the mounting hook 18 in a one-sided passage 22, i.e. open at the top, which is separate from the chamber 2 and therefore does not communicate therewith. Its only function is to hold the base portion 16 of the mounting hook 18. For the purpose of allowing a predetermined amount of water into the means the chamber 2 containing the tablet has a section 2*a* extending upwardly and provided on its upper side with an inlet opening 7*a*. If the volume of water to be allowed into the chamber 2 is to be larger a second upwardly extended chamber section 2*b* can be provided with an opening 7*b* as shown in FIG. 3. In the latter case the passage 22 for holding the hook is provided preferably in the centre of the device between the two additional chamber sections 2*a*, 2*b*. In the former case the passage is provided laterally beside the chamber section 2*a* and above the chamber 2. However, it may be essentially arranged beside the chamber 2 having any desired volume with respect to the tablet 21.

Although not shown in the drawing it will become apparent that the two layers, i.e. the first material layer 1 and the second layer 3 as cover layer, are glued together, welded or otherwise united at the portions where layers 1 and 3 are parallel to each other and directly adjacent. They are not united in the regions comprising the chamber 2, chamber sections 2*a*, 2*b* or the passages or siphon pipes.

The invention thus provides a device for holding an active agent tablet which allows a dosed amount of agent dissolved in water to enter the flushing box when the latter is flushed. The means is inserted in the flushing box just as it is taken from the shelf, thus not requiring an additional package and without it being necessary to open a package or affix the mounting hook in order to insert it in the flushing box. The inventive device can be inserted directly into the flushing box. All that may be necessary is to adjust the mounting hook 18 with respect to the device in order to adjust the upper edge of the device to the maximum water level in the flushing box for allowing the water to penetrate into the device.

In a preferred embodiment the passage 6 widens in the form of a funnel towards the upper edge. The base portion 16 may be provided groove-like recess along its axis. This groove-like recess is provided for introducting water into the chamber 2 when the inner width and breath of the passage 6 corresponds to the inner width and breath of the base portion 16 with lateral shoulders or teeth 15, so that the penetration of water from the upper edge 19 into the chamber 2 is ensured along the groove-like recess along the length of the base portion 16. Otherwise the throughput of water through the passage 6 would at least be impaired due to the dimension of the cross-section of the base 16.

The bottom of the base portion is arrow-tipped in order to facilitate the insertion of the base 16 into the device. This makes it easier for the manufacturer to insert the base portion. At the same time, it prevents the user from inadvertently removing the base portion from the chamber 2 or the passage 6 or 22.

The device described hereinbefore functions as follows. After inserting the device in the flushing box of a WC the height of the mounting hook is adjusted until the upper edge 19 comes to rest slightly below the maximum water level. After flushing or partially flushing the toilet the water level in the flushing box rises. At the same time the preferably vertical siphon pipe section extending downwardly from the siphon section 10 gradually fills up with water until the water level in the flushing box exceeds the level of the siphon section. In this way no water is introduced into the chamber 2 through the siphon section 10 so that the water level in the flushing box will continue to rise until the maximum level is reached. When the water level in the flushing box exceeds a level corresponding to the upper edge 19 the water enters the chamber 2 through the passage 6 or 22 and the opening 7 and the chamber 2 fills up entirely with water. Some of the tablet 21 is thereby dissolved. Any scum or mud produced as a result of the tablet being dissolved remains in the lower portion of the chamber 2, i.e. in the portion of the chamber 2 containing the tablet 21 and thus below the opening 8 provided at about the centre of device shown in the embodiment example. When the WC is flushed the water level in the flushing box falls rapidly to a level below the lower edge 3*a* of the device. During flushing or partial flushing, liquid in which the active agent is dissolved is drawn through the siphon pipe 5 out of the chamber 2. The chamber 2 is thereby emptied from the level of the opening 7 to the level of the opening 8. The amount of solution spent by the device is thus dosed, the dosed amount corresponding practically to the volume of the chamber defined by the openings 7 and 8. The volume of water contained in the passage 6 can be practically neglected. The embodiment of the opening 8 to the siphon pipe 5 above the tablet 21 also has the advantage that scum or residue resulting from the dissolution of the tablet 21, i.e. active agent in concentrated form, cannot at all or can only slightly penetrate from the chamber 2 through the siphon pipe 5, thereby ensuring that the latter is not blocked.

In the inventive device the first and second layer comprise a material which is impermeable to water and water-resistant, by way of example a strong plastic foil. The foil forming the second layer 3 is provided with advertising slogans and text or the like. The printing of the second layer 3 is carried out before the two layers 1 and 3 are united.

We claim:

1. A device for adding a chemical to the flushing water of a WC comprising:

a first layer defining a chamber which is formed by deep drawing;

a second layer overlying the chamber and being sealingly secured to the first layer to thereby close the chamber;

at least one foot section arranged generally below the chamber and defined by a section of a lower wall portion forming a part of the chamber and by an edge of the second layer, the lower wall portion extending generally downwardly at a slant from the second layer and terminating at the section which substantially corresponds in height to that of the edge;

the first layer and the second layer being made from a water-resistant material, the second layer being provided with print on at least one of its two surfaces before it is secured to the first layer;

an elongated mmounting hook including a base portion;

a generally upwardly extending passage defined by the first and second layers communicating the chamber with the exterior and adapted to receive and hold the base portion of the elongated mounting hook and permitting the flow of liquid through the passage when the base portion is disposed therein.

2. The device according to claim 1, comprising a siphon pipe which fluidly communicates with and leads away from the chamber at a location about midway between a top and a bottom of the chamber.

3. The device according to claim 1 wherein the passage is connected with a top opening of the chamber.

4. The device according to claim 1 wherein the chamber comprises at least one chamber section which is upwardly extended from said chamber and is provided with an opening.

5. A device for adding a chemical to the flushing water of a WC comprising:

a first layer of a relatively thin, flexible material having an indentation formed by deep drawing an originally flat sheet;

a second layer of a relatively thin, flexible material overlying the first layer so that the indentation defines a closed chamber between the layers, the layers being in actual contact along their edges and the edges of the layers being sealed to each other to thereby seal the chamber from the exterior;

at least one foot section arranged generally below the chamber and defined by a section of a lower wall portion forming a part of the chamber and by an edge of the second layer, the lower wall portion extending generally downwardly at a slant from the second layer and terminating at the section which substantially corresponds in height to that of the edge;

the first layer and the second layer being made from a water-resistant material, the second layer being provided with print on at least one of its two surfaces before it is secured to the first layer;

an elongated hook for mounting the device in an operative position and including a base portion;

a generally upwardly extending passage defined by the first and second layers communicating the chamber with the exterior and adapted to receive and hold the base portion of the elongated mounting hook, permitting the flow of liquid through the passage when the base portion is disposed therein, and adapted to enable a repositioning of the mounting hook relative to the passage; and;

a siphon pipe for the discharge of fluid from the chamber, an opening defined by at least one of the layers establishing fluid communication between the siphon pipe and the chamber and positioned about midway between a top and a bottom of the chamber.

6. The device according to claim 5 wherein the hook and the passage define means for adjusting the length of base portion extending into the passage to thereby reposition the hook and adjust its relative height.

* * * * *